US010392220B2

(12) United States Patent
Zhang et al.

(10) Patent No.: US 10,392,220 B2
(45) Date of Patent: Aug. 27, 2019

(54) MATERIAL PIPE AND FEEDING SYSTEM

(71) Applicants: BOE TECHNOLOGY GROUP CO., LTD., Beijing (CN); BEIJING BOE DISPLAY TECHNOLOGY CO., LTD., Beijing (CN)

(72) Inventors: Xingkai Zhang, Beijing (CN); Lianzhu Shao, Beijing (CN); Lei Cheng, Beijing (CN); Yaolong Wang, Beijing (CN); Meng Wang, Beijing (CN)

(73) Assignees: BOE TECHNOLOGY GROUP CO., LTD., Beijing (CN); BEIJING BOE DISPLAY TECHNOLOGY CO., LTD., Beijing (CN)

( * ) Notice: Subject to any disclaimer, the term of this patent is extended or adjusted under 35 U.S.C. 154(b) by 143 days.

(21) Appl. No.: 15/714,050

(22) Filed: Sep. 25, 2017

(65) Prior Publication Data

US 2018/0141777 A1 May 24, 2018

(30) Foreign Application Priority Data

Nov. 24, 2016 (CN) ..... 2016 1 274093

(51) Int. Cl.

| | |
|---|---|
| ***B65H 75/18*** | (2006.01) |
| ***B65H 75/10*** | (2006.01) |
| ***B65H 49/36*** | (2006.01) |
| ***B65H 75/30*** | (2006.01) |

(52) U.S. Cl.

CPC ..... *B65H 75/10* (2013.01); *B65H 49/36* (2013.01); *B65H 75/185* (2013.01); *B65H 75/30* (2013.01)

(58) Field of Classification Search

CPC ..... B65H 54/54; B65H 75/10; B65H 75/30

See application file for complete search history.

(56) References Cited

U.S. PATENT DOCUMENTS

| | | | | | |
|---|---|---|---|---|---|
| 859,492 | A * | 7/1907 | Forsberg | B21C 47/30 | 242/575.4 |
| 2,280,970 | A * | 4/1942 | Zesbaugh | B31C 1/086 | 242/573.7 |
| 3,113,744 | A * | 12/1963 | Nisenson | B65H 75/245 | 242/571.5 |
| 3,292,874 | A * | 12/1966 | Tinkham | A47K 10/3836 | 242/571.5 |

(Continued)

FOREIGN PATENT DOCUMENTS

JP 2000001269 A * 1/2000 ..... B65H 75/22

*Primary Examiner* — Jacob J Cigna

(74) *Attorney, Agent, or Firm* — Nath, Goldberg & Meyer; Joshua B. Goldberg

(57) ABSTRACT

The disclosure provides a material pipe and feeding system. The material pipe comprises: a rotation shaft that is provided with an outer thread on an outer peripheral surface; a housing that is covered around an exterior of the rotation shaft and that is provided with an inner thread and a recess spaced from the inner thread on an inner peripheral surface; a fixing member having an axially extending through hole, the fixing member being provided with an outer thread on an outer peripheral surface thereof matching the inner thread of the housing, and the through hole being provided with an inner thread on a hole wall thereof matching the outer thread of the rotation shaft; and a positioning assembly comprising an engaging member detachably disposed in the recess at one end and fixed to the fixing member at the other end.

10 Claims, 1 Drawing Sheet

(56) References Cited

U.S. PATENT DOCUMENTS

| | | | | | |
|---|---|---|---|---|---|
| 3,480,225 | A * | 11/1969 | Alexeff | B65H 75/18 | 242/598.4 |
| 3,596,845 | A * | 8/1971 | Rajnoha | B65H 49/26 | 242/571.4 |
| 4,045,038 | A * | 8/1977 | Obenshain | B23B 31/408 | 242/575 |
| 4,114,909 | A * | 9/1978 | Taitel | B23B 31/305 | 242/571.1 |
| 4,147,312 | A * | 4/1979 | Secor | B65H 75/243 | 242/576.1 |
| 4,327,874 | A * | 5/1982 | Bruno | B65H 75/185 | 242/129.51 |
| 4,681,478 | A * | 7/1987 | Kunz | B65H 18/02 | 242/598.4 |
| 6,328,246 | B1 * | 12/2001 | Hjort | A47K 10/3836 | 242/422.5 |
| 7,261,254 | B2 * | 8/2007 | Mindler | B65H 75/242 | 242/597.3 |
| 2015/0360904 | A1 * | 12/2015 | Swanson | B65H 75/28 | 242/571 |

* cited by examiner

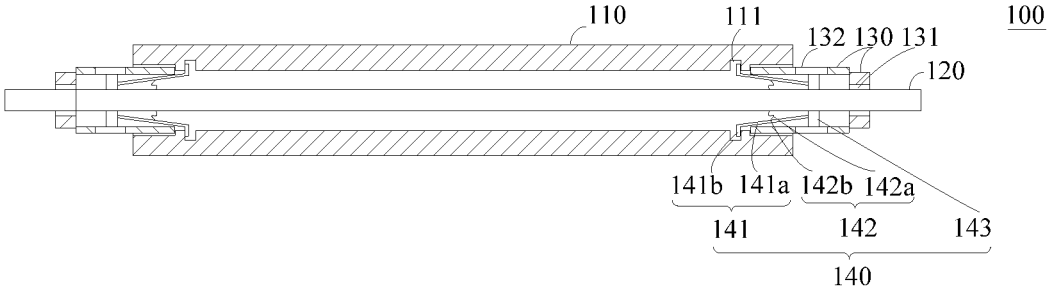
110
111
132
130
131
100
120
141b
141a
142b
142a
141
142
143
140

MATERIAL PIPE AND FEEDING SYSTEM

CROSS-REFERENCE TO RELATED APPLICATION

This application claims the priority of Chinese Patent Application No. 201621274093.8 submitted to the Chinese Intellectual Property Office on Nov. 24, 2016, the disclosure of which is incorporated herein in its entirety by reference.

TECHNICAL FIELD

The present disclosure relates to the technical field of device manufacture, and particularly relates to a material pipe and a feeding system having the same.

BACKGROUND OF THE INVENTION

Generally, during the manufacture process of display panels, the mounting method of auxiliary materials, for example, silicone resin, is usually sleeve-reel mounting. Specifically, the auxiliary material is covered around an outer surface of the sleeve, and a rotation shaft is provided inside of the sleeve and connected thereto by disposing a conical positioning means at both sides thereof, wherein the conical positioning means is fixed by an inner hexagon screw at one side and by friction at the other side. The rotation of the rotation shaft drives the sleeve to rotate, and then further drives the auxiliary material to rotate.

However, for the above sleeve-reel mounting method, the conical positioning means is easy to be loosened, for example, by an external force or vibration, during operation so that the auxiliary material cannot rotate together with the rotation shaft and breaks due to a pressure repeatedly acted on certain position of the auxiliary material by a high-temperature pressing head of the pressing printed circuit board, thereby resulting in, for example, defective batches.

Therefore, it is an urgent technical problem for those skilled in the art to solve to design a material pipe capable of effectively fixing the auxiliary material.

SUMMARY

The present disclosure has been accomplished in order to at least partially solve the problems in the prior art. The present disclosure provides a material pipe capable of effectively fixing the auxiliary material and a feeding system having the same.

According to one aspect of the disclosure, there is provided a material pipe comprising:

a rotation shaft that is provided with an outer thread on an outer peripheral surface of at least one end;

a housing that is covered around an exterior of the rotation shaft and that is provided with an inner thread and a recess spaced from the inner thread on an inner peripheral surface of at least one end;

a fixing member having an axially extending through hole and an operation hole formed in and passing through a side wall of the fixing member, the fixing member being provided with an outer thread on an outer peripheral surface thereof matching the inner thread of the housing, and the through hole being provided with an inner thread on a hole wall thereof matching the outer thread of the rotation shaft; and a positioning assembly comprising an engaging member detachably disposed in the recess at one end and fixed to the fixing member at the other end, a portion of the engaging member corresponding to the operation hole in position, and the one end of the engaging member being separable from the recess by operation on the engaging member through the operation hole.

The engaging member may comprise a connecting rod and a clasp formed at one end of the connecting rod, wherein the clasp is detachably disposed in the recess and the connecting rod is hinged to the fixing member at the other end.

The positioning assembly may further comprise a resilient member that is fixed at a middle portion of the connecting rod between the rotation shaft and the connecting rod.

The resilient member may comprise a spring and two hooks formed at two ends of the spring, wherein one hook is fixedly connected to the connecting rod and the other hook is detachably connected to the rotation shaft.

The positioning assembly may further comprise a pressing member that is fixedly disposed on the connecting rod and exposed through the operation hole.

The positioning assembly may comprise a plurality of connecting rods.

The plurality of connecting rods may be uniformly distributed around the rotation shaft in a circumferential direction.

The number of the operation holes may be two, and the two operation holes are disposed in the side wall of the fixing member symmetrically with respect to an axis of the fixing member.

Both ends of the housing may be provided with the fixing member and the positioning assembly.

According to another aspect of the disclosure, there is provided a feeding system comprising a material pipe for winding a material, wherein the material pipe is the material pipe as described above.

BRIEF DESCRIPTION OF THE FIGURES

Accompanying drawings are provided for further understanding of this disclosure and constitute a part of the specification. Hereinafter, these drawings are intended to explain the disclosure together with the following exemplary embodiments, but should not be considered as a limitation of the disclosure, in which:

FIG. 1 is a schematic diagram showing a configuration of a material pipe according to the exemplary embodiment of the disclosure.

DETAILED DESCRIPTION

Hereinafter, exemplary embodiments of the disclosure will be described in detail in conjunction with the accompanying drawings. It should be understood that the exemplary embodiments as set forth herein are merely for the purpose of illustration and explanation of the disclosure and should not be constructed as a limitation thereof.

According to one aspect of the disclosure, there is provided a material pipe. As shown in FIG. 1, the material pipe 100 comprises a housing 110, a rotation shaft 120 and a fixing member 130. The housing 110 is covered around an exterior of the rotation shaft 120, and at least one end of the housing 110 is fixedly connected to the rotation shaft 120 via the fixing member 130.

The fixing member 130 is provided with an axially extending through hole 131. In order to realize fixed connection between the fixing member 130 and the rotation shaft 120, the through hole 131 may be provided with an inner thread on a hole wall thereof and the rotation shaft 120 may be provided with an outer thread on an outer peripheral surface thereof matching the inner thread on the hole wall of the through hole 131. Therefore, the fixing member 130 may be fixedly connected with the rotation shaft 120 by the matching inner and outer threads.

In order to realize fixed connection between the fixing member 130 and the housing 110, the fixing member 130 may be provided with an outer thread on an outer peripheral surface thereof and the housing 110 may be provided with an inner thread on an inner peripheral surface at one end thereof matching the outer thread on the outer peripheral surface of the fixing member 130. Therefore, the fixing member 130 may be fixedly connected with the housing 110 by the matching inner and outer threads.

The housing 110 is further provided with a recess 111 on the inner peripheral surface thereof. It should be understood that the recess 111 should be disposed to avoid the inner thread on the inner peripheral surface of the housing 110. The material pipe 100 further comprises a positioning assembly 140. In this exemplary embodiment, the positioning assembly 140 includes an engaging member 141 that is detachably disposed in the recess 111 at one end and fixed onto the fixing member 130 at the other end. In this way, the case of loosened threads at a matching position when the housing 110 is under an external force or vibration is prevented. It should be understood that the fixing member 130 and the positioning assembly 140 may also be formed as one-piece, thereby reducing the number of components and facilitating the management of the components.

In order to facilitate detachment of the engaging member 141, an operation hole 132 passing through a side wall of the fixing member 130 may be provided on the fixing member 130. In this exemplary embodiment, a portion of the engaging member 141 that is connected to the fixing member 130 corresponds to the operation hole 132 in position. The operation on the engaging member 141 through the operation hole 132 may separate the one end of the engaging member 141 from the recess 111 of the housing 110.

It should be understood that when one end of the housing 110 is fixed by the fixing member 130, the other end thereof may be fixed in other ways.

For the material pipe 100 in this exemplary embodiment, on the one hand, the fixed connection between the fixing member 130 and the rotation shaft 120 is realized by matching the inner thread on the hole wall of the through hole 131 of the fixing member 130 to the outer thread on the outer peripheral surface of the rotation shaft 120. Further, the fixed connection between the fixing member 130 and the housing 110 is realized by matching the inner thread on the inner peripheral surface at the end of the housing 110 to the outer thread on the outer peripheral surface of the fixing member 130. When the rotation shaft 120 is rotated, a torque may be transmitted from the rotation shaft 120 to the housing 110 to drive the housing 110 to rotate so that the material (not shown) on the housing 110 is rotated together.

On the other hand, when the material pipe 100 has been used for a long time or is under an external force or vibration, the housing 110 and the rotation shaft 120 may be effectively fixed together since the engaging member 141 of the positioning assembly 140 is disposed in the recess 111 of the housing 110.

In a third aspect, when the material on the housing 110 is used up, or the material pipe 100 requires maintenance due to structural damages after long use, it is desired to remove the material pipe 100 to relocate a new material or perform maintenance of the material pipe 100. Since one end of the engaging member 141 of the positioning assembly 140 is detachably disposed in the recess 111 of the housing 110, and the engaging member 141 may be operated through the operation hole 132, the engaging member 141 may be conveniently operated so that the engaging member 141 is separated from the recess 111 of the housing 110. In such case, the fixing member 130 may be detached from the housing 110 and the rotation shaft 120 to separate the housing 110 from the rotation shaft 120. Then, the new material may be relocated or the maintenance of the material pipe 100 may be performed, which will greatly improve the work efficiency of an operating device using the material pipe 100.

In this exemplary embodiment, the engaging member 141 comprises a connecting rod 141*a* and a clasp 141*b* formed at one end of the connecting rod 141*a*. The clasp 141*b* is detachably disposed in the recess 111 and the connecting rod 141*a* is hinged to the fixing member 130 at the other end.

The material pipe 100 according to this exemplary embodiment has a structure that can realize detachable connection. When the engaging member 141 needs to be detached, a pressure is applied onto the connecting rod 141*a* through the operation hole 132 so that the clasp 141*b* is separated from the recess 111 to realize separation of the engaging member 141 from the housing 110. Such configuration of the material pipe 100 realizes reliable and detachable connection between respective members with a simple structure.

In this exemplary embodiment, the positioning assembly 140 further comprises a resilient member 142 corresponding to the connecting rod 141*a*. The resilient member 142 is fixed at a middle portion of the connecting rod 141*a* between the rotation shaft 120 and the connecting rod 141*a*.

In the material pipe 100 according to the exemplary embodiment, by means of the resilient member 142, the engaging member 141 may be easily detached.

In this exemplary embodiment, the resilient member 142 comprises a spring 142*a* and two hooks 142*b* formed at two ends of the spring 142*a*. One hook 142*b* is fixedly connected to the connecting rod 141*a*, and the other hook 142*b* is detachably connected to the rotation shaft 120.

In the material pipe 100 according to the exemplary embodiment, the hook 142*b* at one end of the spring 142*a* is connected to the connecting rod 141*a*, and the hook 142*b* at the other end of the spring 142*a* is detachably connected to the rotation shaft 120. Specifically, the rotation shaft 120 may be provided with a hole matching the hook 142*b* and to which the hook 142*b* is hung. Obviously, the hook of the spring 142*a* that is connected to the connecting rod 141*a* may also be connected in this way. When the material on the housing 110 is used up, it is desired to remove the material pipe 100 to relocate a new material. Then, the connecting rod 141*a* may be operated through the operation hole 132 so that the connecting rod 141*a* presses the spring 142*a* downward to separate the clasp 141*b* within the recess 111 from the recess 111, thereby realizing separation of the housing 110 from the engaging member 141. When the connecting rod 141*a* is not under pressure, the clasp 141*b* may be re-engaged with the recess 111 under an action of the spring 142*a*. By providing the spring 142*a*, the engaging stability between the engaging member 141 and the housing 110 is enhanced.

It should be noted that when the hook 141*b* at one end of the connecting rod 141*a* is engaged with the recess 111 of the housing 110, the spring 142*a* of the resilient member 142 is in a compressed state, but not compressed to the limit. The purpose of such setting is that, on the one hand, a steady engagement between the clasp 141*b* and the recess 111 is guaranteed, while on the other hand, when the engagement between the clasp 141*b* and the recess 111 needs to be removed, an operator may operate the connecting rod 141*a* to continue pressing the spring 142*a* downward to complete removal of the engagement between the clasp 141*b* and the recess 111.

In this exemplary embodiment, in order to further facilitate detachment of the engaging member 141, the positioning assembly 140 may further include a pressing member 143. The pressing member 143 is fixedly disposed on the connecting rod 141*a* and exposed through the operation hole 132.

In the material pipe 100 according to the exemplary embodiment, by providing the pressing member 143, the engaging member 141 may be easily detached. Specifically, when the material on the housing 110 is used up or the material pipe 100 requires maintenance, firstly, the operator applies a pressure to the pressing member 143 toward the rotation shaft 120, and the applied force is transmitted to the connecting rod 141*a* connected with the pressing member 143 so that the connecting rod 141*a* is moved along a direction of the applied force to separate the clasp 141*b* at the one end of the connecting rod 141*a* from the recess 111. After that, the fixing member 130 is removed from the rotation shaft 120 and the housing 110 so that the housing 110 is separated from the rotation shaft 120. In such case, the material may be relocated or maintenance of the material pipe 100 may be performed.

In this exemplary embodiment, in order to further facilitate detachment of the engaging member 141, the positioning assembly 140 includes a plurality of connecting rods 141*a*. Furthermore, the plurality of connecting rods 141*a* may be uniformly distributed around the rotation shaft 120 in a circumferential direction. Obviously, the plurality of connecting rods 141*a* may also be arranged in other ways.

In this exemplary embodiment, in order to further facilitate detachment of the engaging member 141, the number of the operation holes 132 is two, and two operation holes 132 are disposed on the side wall of the fixing member 130 symmetrically with respective to an axis of the fixing member 130. Obviously, more operation holes 132 may be provided as long as the strength of the fixing member 130 is guaranteed.

In this exemplary embodiment, both ends of the housing 110 are provided with the fixing member 130 and the positioning assembly 140.

In the material pipe 100 according to the exemplary embodiment, the fixing member 130 and the positioning assembly 140 are provided at both ends thereof. In such case, a combined structure of the housing 110 and the rotation shaft 120 is more stable. At the same time, when the material is used up, a new material may be relocated by removing the fixing member 130 at either end.

As a specific application example, for example, the above material pipe 100 may be used for transporting an auxiliary material during the manufacture process of display panels. For example, the auxiliary material may be silicone resin. In use, the silicone resin is firstly placed onto the housing 110 and then the fixing member 130 is provided at two ends of the housing 110 respectively. The housing 110 and the rotation shaft 120 are fixedly connected to each other through the fixing member 130. Meanwhile, the positioning assembly 140 is further disposed between the housing 110 and the fixing member 130. By (detachably) engaging the clasp 141*b* at one end of the connecting rod 141*a* with the recess 111 of the housing 110, it is ensured that the housing 110 will be rotated together with the rotation shaft 120 and thus drive the silicone resin on the housing 110 to rotate. Even if a thread failure occurs at the thread matching portion between the fixing member 130 and the housing 110 or between the fixing member 130 and the rotation shaft 120 due to influence of, for example, an external force or vibration on the material pipe 100, the existing engaging member 141 can still ensure the housing 110 to be rotated together with the rotation shaft 120 and prevent breakage of the silicone resin at a certain position due to repeated pressing on the certain position of the silicone resin (e.g., under repeated pressing by a high-temperature pressing head of a pressing printed circuit board).

According to another aspect of the disclosure, there is provided a feeding system (not shown) comprising a material pipe for winding a material, the material pipe being the above described material pipe 100.

The feeding system according to the disclosure comprises the above described material pipe 100. During the feeding process, on the one hand, the housing 110 is fixedly connected to the rotation shaft 120 through the fixing member 130. On the other hand, the material pipe 100 is further provided with a positioning assembly 140. By means of cooperation between the engaging member 141 of the positioning assembly 140 and the recess 111 of the housing 110, it is ensured that the housing 110 will be rotated together with the rotation shaft 120 and thus drive transportation of the material. Meanwhile, when the material is used up and a new material needs to be relocated, the engaging member 141 may be operated through the operation hole 132 so that the engaging member 141 is separated from the housing 110. Then the fixing member 130 may be removed to separate the housing 110 from the rotation shaft 120. In this case, the new material may be placed.

It should be understood that the above embodiments are merely exemplary embodiments for the purpose of illustrating the principle of the disclosure, and the disclosure is not limited thereto. Various modifications and improvements can be made by a person having ordinary skill in the art without departing from the spirit and essence of the disclosure. Accordingly, all of the modifications and improvements also fall into the protection scope of the disclosure.

What is claimed is:

1. A material pipe comprises:

a rotation shaft that is provided with an outer thread on an outer peripheral surface of at least one end;

a housing that is covered around an exterior of the rotation shaft and that is provided with an inner thread and a recess spaced from the inner thread on an inner peripheral surface of at least one end;

a fixing member having an axially extending through hole and an operation hole formed in and passing through a side wall of the fixing member, the fixing member being provided with an outer thread on an outer peripheral surface thereof matching the inner thread of the housing, and the through hole being provided with an inner thread on a hole wall thereof matching the outer thread of the rotation shaft; and a positioning assembly comprising an engaging member detachably disposed in the recess at one end and fixed to the fixing member at the other end, a portion of the engaging member corresponding to the operation hole in position, and the one end of the engaging member being separable from the recess by operation on the engaging member through the operation hole.

2. The material pipe according to claim 1, wherein the number of the operation holes is two, and the two operation holes are disposed in the side wall of the fixing member symmetrically with respect to an axis of the fixing member.

3. The material pipe according to claim 1, wherein both ends of the housing are provided with the fixing member and the positioning assembly.

4. The material pipe according to claim 1, wherein the engaging member comprises a connecting rod and a clasp formed at one end of the connecting rod, the clasp is detachably disposed in the recess and the connecting rod is hinged to the fixing member at the other end.

5. The material pipe according to claim 4, wherein the positioning assembly further comprises a resilient member that is fixed at a middle portion of the connecting rod between the rotation shaft and the connecting rod.

6. The material pipe according to claim 5, wherein the resilient member comprises a spring and two hooks formed at two ends of the spring, one hook is fixedly connected to the connecting rod and the other hook is detachably connected to the rotation shaft.

7. The material pipe according to claim 5, wherein the positioning assembly further comprises a pressing member that is fixedly disposed on the connecting rod and exposed through the operation hole.

8. The material pipe according to claim 5, wherein the positioning assembly comprises a plurality of connecting rods.

9. The material pipe according to claim 8, wherein the plurality of connecting rods are uniformly distributed around the rotation shaft in a circumferential direction.

10. A feeding system comprising a material pipe for winding a material, wherein the material pipe is the material pipe according to claim 1.

* * * * *